United States Patent [19]

Hussein

[11] 4,369,943

[45] Jan. 25, 1983

[54] MODEL TRAIN CROSSING GATE

[76] Inventor: Said Hussein, 2814 Kennedy Blvd., Jersey City, N.J. 07306

[21] Appl. No.: 220,417

[22] Filed: Dec. 29, 1980

[51] Int. Cl.[3] ..... B61L 1/08; B61L 29/22

[52] U.S. Cl. ..... 246/127; 246/473 A

[58] Field of Search ..... 46/45, 226, 227, 230, 46/231, 236–239, 216–218; 246/114, 114 A, 122 A, 122 R, 125–127, 292–296, 360, 473 A, 473 R

[56] References Cited

U.S. PATENT DOCUMENTS

| | | | |
|---|---|---|---|
| 1,806,497 | 5/1931 | Polak | 246/127 |
| 1,912,193 | 5/1933 | Handy | 246/255 |
| 2,810,067 | 10/1957 | Fowler | 246/479 |
| 3,179,063 | 4/1965 | Case et al. | 246/114 R |
| 3,418,750 | 12/1968 | Ryan et al. | 46/216 |

OTHER PUBLICATIONS

Thorne "Practical Electronic Projects for Model Railroads", p. 69, Kalmback Publ. Co., (1974).

"Detection Systems"-Brochure publ. by Circuitron.

Fowler's "Crossing Gate Installation Instructions," Model Landscape Co., Penn Laird, Va.

*Primary Examiner*—F. Barry Shay

*Attorney, Agent, or Firm*—Brumbaugh, Graves, Donohue & Raymond

[57] ABSTRACT

A detector circuit for a model railroad employs two pairs of magnetically-operated relays positioned on either side of a grade crossing along a set of tracks. In addition a single magnetically-operated relay is located at the grade crossing and is given an orientation orthogonal to that of the two pairs of relays. A locomotive of the model railroad is equipped with a first magnet for operating the pairs of relays and at least one car has a second magnet for operating the relay at the grade crossing. A control circuit is connected to the relays such that crossing gates at the grade crossing are lowered, a bell is sounded, and lights are flashed whenever the locomotive magnet passes over the pairs of relays traveling toward the grade crossing. The control circuit also raises the crossing gate and deactivates the bell and flashing lights whenever the car magnet moves over the relay at the grade crossing or the locomotive magnet moves over one of the pairs of relays while traveling away from the grade crossing.

18 Claims, 4 Drawing Figures

MODEL TRAIN CROSSING GATE

BACKGROUND OF THE INVENTION

The present invention relates to model railroad train crossing gates and, more particularly, to apparatus for detecting the approach of a model train and activating the crossing gate in response thereto.

In model railroading great efforts are made to create toy railroad devices, e.g. trains, signals etc., which are as close to the real device as possible. With respect to grade crossing gates it is desirable to have the operation of the gates activated by the approach of the model train to the grade crossing, regardless of the direction from which the crossing is approached. As a result, a train detection system is needed which has this capability.

Of the prior art detection systems the track switch and reed switch systems are not considered to be bi-directional. A track switch system, such as that disclosed in U.S. Pat. No. 3,418,750 to Ryan et al., employs a contact member beneath or along side the tracks, which member is actuated by the weight of the locomotive or a shoe extending from its side, respectively. The operation of the switch causes a motor or an electrical coil (such as in U.S. Pat. No. 3,179,063 to Case et al. or U.S. Pat. No. 2,810,067 to Fowler), or a mechanical member as in the Ryan et al. patent to operate the crossing gate. With the reed switch system the same operation as with the track switch is accomplished via a magnetic reed relay activated by a magnet located on the train. Only one of the track or reed switches, positioned to one side of the grade crossing, is used in such a system because the switch itself cannot determine which way the train is moving. If an attempt were made to make this system bi-directional by placing such switches on both sides of the grade crossing along the tracks, the effort would be hampered by the fact that the gate would close both as the train approached the grade crossing and as it left the grade crossing.

With a series relay detection system a sensitive relay is connected in series with the power supply and the track. When power is applied to a block of track and a locomotive is in that block so as to draw current from the supply, the series relay operates. Such a system, while bi-directional, only detects the locomotive and it is expensive.

Electronic current measuring circuitry and optoelectronic detectors using photocells or infrared light sources and photo transistors are also bi-directional, but they are expensive and are so sensitive to current changes and light changes that their operations are erratic.

Once the presence of the train has been detected the gate must be operated in a manner resembling a real crossing gate. Typically real crossing gates are lowered slowly and are raised slowly, independent of the speed of the train. However, most model gates snap down and up rapidly, particularly those operated by an electrical coil or a mechanical member.

Some real life crossing gates are also equipped with two alternately flashing lights and a sounding bell which operate synchronously. However, the typical models available in the prior art either do not provide these features or are unable to operate them synchronously. Some systems use flashing lights controlled by complicated electronic devices which are expensive. Also the regular beat of a bell has been achieved by slow motion motors driving a cam equipped with teeth that act on the contacts of a micro-switch to operate the bell. See for example "Practical Electronic Projects For Model Railroads" by Thorne, Kalmbach Publishing Co. (1974), p. 69. Alternately there are prior art systems that create a bell sound electronically by mixing several tones. These systems, however, are also expensive.

SUMMARY OF THE INVENTION

The present invention is directed to a grade-crossing gate assembly for a model railroad in which the movement of the train is detected by magnetically-actuated devices regardless of the direction from which the train approaches the grade crossing, and the devices initiate a slow movement of the gate accompanied with synchronized flashing lights and a sounding bell.

In an illustrative embodiment of the invention the desired operation is achieved by utilizing a pair of similarly oriented magnetic reed relays or Hall-effect devices located beneath the tracks on each side of the grade crossing, wherein the relay of each pair that is most remote from the grade crossing acts to create a signal opening the gate and the other relays of the pairs create a signal closing the gate. A further magnetically-operated relay with an orientation that is orthogonal to that of the pairs of relays is positioned beneath the tracks at the grade crossing. This single relay creates a signal opening the gate. In order to activate the relays, magnets are positioned in the locomotive of the train and in the last car of the train. The locomotive magnet is oriented to activate the pairs of relays while the last car magnet operates the single relay at the grade crossing.

The reed or Hall-effect relays create momentary signals which are indications of the location of the train. These signals are applied to a latching relay which controls the supply of power to an electrical motor via two microswitches controlled by a first cam on the shaft of the motor. As a result a change of state of the latching relay will cause the electrical motor to turn a fixed amount determined by the cam, which amount is just sufficient to raise or lower the crossing gate. The actual raising and lowering of the crossing gate in a slow fashion simulating real-life gates is due to speed reducing gears on the motor and is effected by means of a second cam on the motor which moves a mechanical arm connected to a push rod of the crossing gate assembly.

In addition to supplying power to the motor, the latching relay supplies power to a bell circuit that includes the coil of the bell, a variable resistance and an intermittently opening switch, e.g. an automobile turn-signal flasher. Operation of the intermittent device causes the bell circuit to open and close in a regular fashion and thus causes the bell coil to move its clapper back and forth so as to sound in the bell in a regular fashion. The bell coil also operates a switch whose contacts are respectively connected to two warning lights on the crossing gate. Because of this arrangement the lights flash on alternately in synchronism with the sounding of the bell.

In a preferred embodiment the latching relay is in the form of a microswitch with a magnet positioned at the end of its movable contact. A coil is located next to the magnet and either attracts it or drives it against a stop.

The present invention thus combines a slow motion actuator for the gate, warning bells, alternating flashing lights and detection-control circuits in a single system.

This is contrary to prior systems in which these units are separate independent devices. As a result the overall cost of the arrangement is reduced, its size is reduced and its operation is simplified.

BRIEF DESCRIPTION OF THE DRAWINGS

The foregoing and other features of the present invention will be more readily apparent from the following detailed description and drawings of an illustrative embodiment of the invention in which.

DESCRIPTION OF AN ILLUSTRATIVE EMBODIMENT

Figure 1:
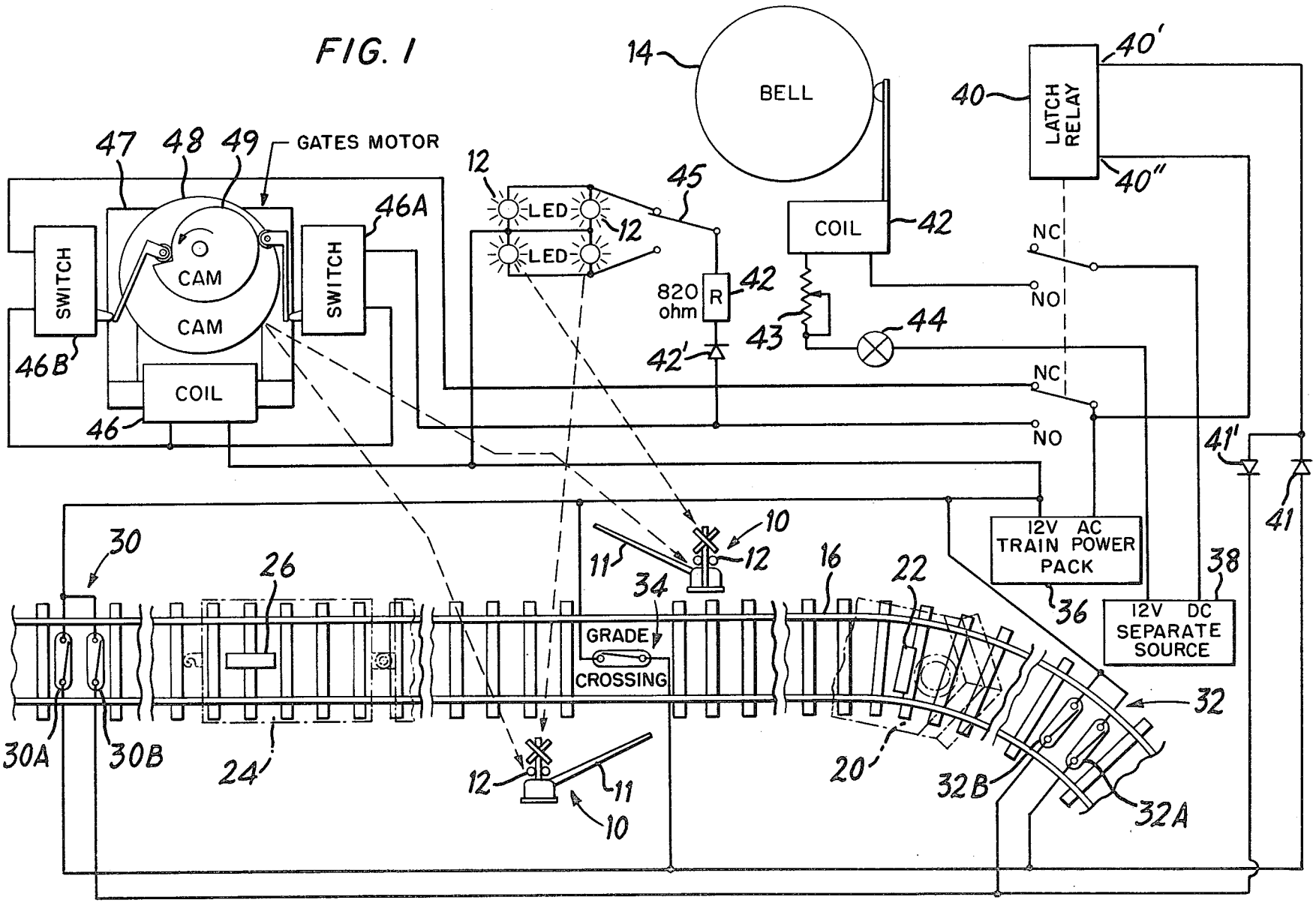
FIG. 1 illustrates the magnetic reed relay detector arrangement and the electrical circuit of the present invention.
Figure 2:
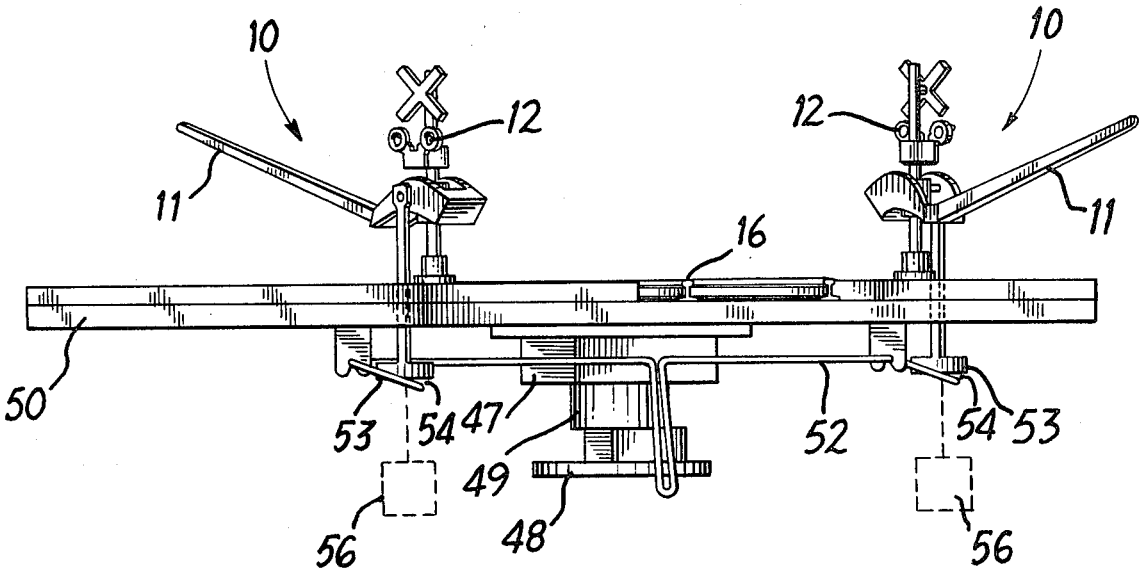
FIG. 2 illustrates the mechanical operation of the crossing gate.

As shown in FIG. 1 grade crossing gates 10 are located at a grade crossing on respective sides of model railroad tracks 16. Each gate assembly includes a movable barrier 11 that can be raised or lowered, as well as pairs of alternately-operated flashing warning lights 12. These gate assemblies may be modified versions of conventional designs, such as those manufactured by Model Landscaping Co. of Penn Laird, Va. A bell 14 which is sounded in synchronism with the flashing of lights 12 is positioned in the vicinity of the grade crossing, and may be mounted on the gates 10. Preferably the bell is mounted below a plate 50 supporting the layout (FIG. 2). Because of the small size of the units employed, the entire arrangement can be mounted on plate 50.

A detection circuit is needed in order to indicate when the gates should be operated. To serve this purpose pairs of magnetically-operated relays, which have the same orientation, e.g., reed relays 30, 32, are positioned beneath the tracks and signal the approach of a train. As shown in FIG. 1 the pair of relays 30 is to the left of the grade crossing along the tracks and the pair 32 is to the right. Normally these pairs of approach relays are separated from the crossing by a distance greater than the length of the longest train expected. At the crossing itself a single reed relay 34 with an orientation orthogonal to that of relays 30, 32 is located beneath the tracks.

All of the reed relays used are of the normally open type and are closed by magnets on the train used in the system. In particular the locomotive 20 of the train carries a magnet 22 arranged to operate the relays 30, 32 while the last car 24 of the train carries a magnet 26 that will operate relay 34. For the purpose of creating operating signals from these relays the common line from a train power supply 36, which is used to drive the engine, is connected to one side of all of the relays. Thus, whenever one of these relays is closed, a ground path can be established. The relays 30A, 32A of each pair, which relays are the ones farthest from the grade crossing, as well as the relay 34, have their other side connected together and applied to one end 40' of a coil of a latching relay 40 through a diode 41. The other end 40" of the coil is connected to the output of power supply 36. The relays 30B, 32B of each pair, which are closest to the grade crossing, are also connected together, but they are applied to the coil end 40' of latching relay 40 through diode 41'. Diode 41' has a polarity opposite to that of diode 41.

Latching relay 40 is part of a control circuit which causes the crossing gate to operate. This control circuit includes the coil 42 of bell 14, a switch 45 for operating the flashing lights and a coil 46 of a gate motor 47. When the locomotive 20 carries the magnet 22 over the pair of reed relays 30, while moving in the direction toward the grade crossing, the relay 30A completes a circuit including relay 40, diode 41 and supply 36. As a result an AC voltage, e.g. 12 VAC, from supply 36 is applied to diode 41, whereby the voltage is rectified so that only positive cycles of the AC voltage are applied to operate the coil of relay 40 in a direction to put its contacts in the normally-closed (NC) position. Since the contacts are already in this position, nothing happens. A short time later, depending on the spacing of the relays and the speed of the train, relay 30B will be activated and the AC voltage will be applied to diode 41' so that negative cycles of the voltage are applied to operate the coil of relay 40 in the opposite direction, i.e. in the direction to put its contacts in the normally-open (NO) position. Because of the latching feature of the relay, its contacts will remain in the normally-open (NO) position.

Figure 3:
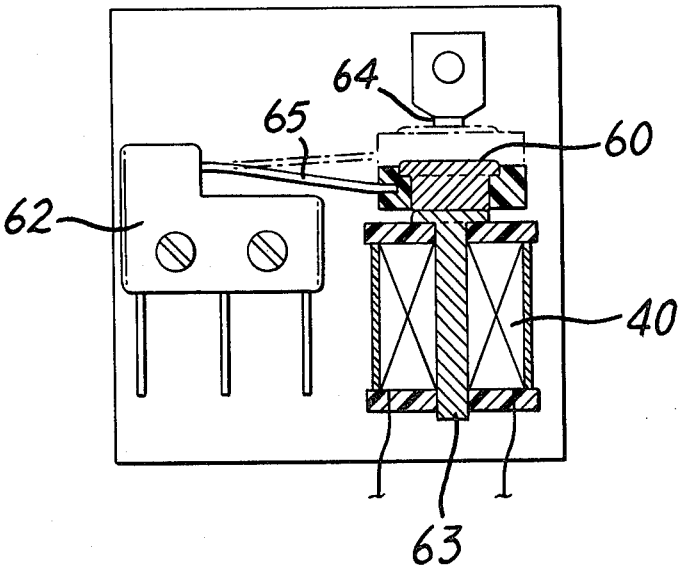
FIG. 3 illustrates a simple latching relay useful with the present invention.

In particular diode 41' will create a rectified AC current through the coil 40 which creates a field attracting the permanent magnet 60 toward the coil 40 (FIG. 3). Even when this field is removed the relay will stay latched because the magnet will be attracted to the coil core piece 63. Since the magnet is connected to the movable lever of microswitch 62, the state of the contacts will change and then will hold that position. As a result the contacts of switch 62, which are driven by relay 40, will change from that shown in FIG. 1 to the opposite state.

Operation of the contacts of relay 40 will allow 12 VAC from power supply 36 to be applied to the light circuit and the gate motor. The bell circuit includes the bell coil 42, a variable resistor 43 and an intermittently-operating device 44, e.g., an automobile turn-signal flasher such as Sylvania model No. 552. The flasher is rated for 12 volts, its heater has a resistance of 40 ohms and it requires a load of 3–15 ohms. With the series arrangement shown, the bell coil acts as part of the load. For best results the coil is made with sufficient windings to produce a resistance of 5 ohms because with only enough windings to produce a resistance of only 3 ohms the field from the coil is too weak and with 15 ohms the flasher operation is weakened because of a lack of current for its heater coil.

Upon closing of the bell circuit by the latching relay there is a large voltage drop across the heater coil of the flasher and a small one across the bell coil. The flasher heater heats a metalic switch plate in the flasher until it flips to a new position in which it closes a set of contacts across the heater. This shorts out the heater, allowing the metal plate to begin to cool, and applies a large voltage to the bell coil, causing it to attract an armature so as to force a bell clapper attached to the armature against the bell, thereby sounding one beat. After about 1–2 seconds the metalic plate has cooled enough so that it flips back to its original position, whereby the flasher contacts are opened, the coil voltage is reduced to its original valve and the heater begins to heat the metalic plate again. The low voltage on the coil would still be enough to create a magnetic attraction sufficient to keep the armature attracted to the coil, but a spring is provided to break the connection. A nonmagnetic stud should be located in the armature to make this easier.

The whole process of forcing the clapper against the bell is repeated at a regular rate as long as the relay 40 is latched. By adjusting the value of variable resistance 43, which has a value of 0–5 ohms, this rate can be changed over the range of 30 to 50 beats per minute (i.e. every 2 to 1.2 seconds).

The latching of relay 40 also applied AC voltage to diode 42' which rectifies it to generate a positive current to activate warning lights 12. These lights may be formed by two pairs of light emitting diodes (LED's) 12 with one light of each pair being assigned to each gate. The LED's are wired so that one end of both pairs is connected to the common line of power supply 36 and the other ends of the pairs are connected to respective terminals of a switch 45. The movable contact of switch 45 is mechanically coupled to and moves with the bell armature. The positive voltage from diode 42' is applied to this movable contact, thus alternately lighting the pairs of lights in synchronism with the operation of the bell.

When the latching relay is latched the ac voltage of supply 36 is applied through a set of its contacts to a micro-switch 46A, which in turn applies the voltage to coil 46 of electrical motor 47. Since the common line of supply 36 is connected to the other side of the coil 46, motor 47 operates and, through a series of speed reducing gears, it turns cams 48, 49. The motor continues to operate until microswitch 46A is allowed to open when its roller drops off the raised portion of cam 49.

As best seen in FIG. 2 the rotation of cam 48 causes the deflection of a mechanical arm 52, which deflection translates into a simultaneous pushing force on the plungers 53 of gates 10, which force causes the gates to lower.

The speed reduction and the cam size are chosen so that the gates are lowered and raised slowly. Thus as a result of the latching of relay 40 the bell 14 is sounded on a regular basis, the lights 12 are alternately flashed in synchronism with the bell and the gates are slowly lowered together. There is a delay created in the gate action when the motor is energized to close the gates. This delay is caused by a gap 54 between the cam lever 52 and the gate plunger 53 as shown in FIG. 2. Typically the delay is about 4 seconds and provides time for the bell to start ringing before the gates start to lower, thus simulating a real grade crossing.

Depending on the type of conventional gates used, modifications may be necessary. If, for example, the weight and balance of the gate is such that its plunger is not forced fully downward onto the lever by gravity, it will be necessary to install weights 56 on the ends of the plunger.

If the train continues to move forward in the direction shown in FIG. 1, eventually the magnet 26 in the last car will pass over relay 34 and operate it. Operation of this relay connects the common side of supply 36 to diode 41 so that the AC voltage applied to coil 40 is positively rectified. As a result a field opposite to the field that latched the relay is created and causes the relay 40 to release. In particular a field is created which is strong enough to break the attraction of the permanent magnet 60 to the core of coil 40, allowing it and the lever of switch 62 to swing away until contact is made with stop 64 (FIG. 3). The latching relay shown was designed for use in the present invention and has the advantages of simplicity and low cost. However, other commercially available latching relays activated by reed relays may also be used with minor modifications to the circuit. It should be noted here that the latching relay shown here has advantage over the commercial latching relays, that is, our latching relay is very sensitive and can be operated by low current.

When the contacts of relay 40 return to their initial condition due to a release of relay 40, i.e. as shown in FIG. 1, the bell and lights are deactivated. However, ac voltage is supplied to motor 47 via microswitch 46B, which was closed during lowering of the gates by cam 49. The motor will turn until the roller of switch 46B drops off the raised portion of cam 49 and opens switch 46B. While the motor is operating cam 48 moves so that the lever arm 52 will slowly return to its original position, which has the effect of raising the plungers 53 of the crossing gates.

If the direction of travel of the train on the tracks is changed from that shown in FIG. 1, i.e., the train is traveling from right to left in the drawing, the grade crossing gate will still operate in a proper manner. Magnet 22 in the train locomotive will operate release relay 32A first, which will have no effect, and then relay 32B, which will latch relay 40. This will start the gate lowering process and activate the lights and bell. When the last car magnet 26 passes over the grade-crossing relay 34, the latching relay will be released, the bell and lights deactivated, and the gate-raising process begun. Thus the present invention achieves bi-directional operation through the use of magnetic reed relays.

Regardless of the direction of approach of the train to the grade crossing, when the engine leaves the crossing heading away from it, it is important that it not reach the pair of approach relays on that side before the last car reaches the crossing. Otherwise the gates would rise before the train is completely through the crossing. This is assured by separating the approach relay pairs from the crossing by a distance greater than the longest train. In this regard it should be noted that when the engine passes over the approach relays heading away from the grade crossing, the latch relay 30B or 32B is passed first. However, a delay in the bell circuit operation and the previously mentioned delay in the gate cam operation due to the gap 54 of FIG. 2, prevent this activation of relay 40 from creating any physical changes until the release relay, 30A or 32A, is reached and the relay 40 is released. The bell delay is achieved by using a normally open contact flasher. Thus it takes from 1.2 to 2 seconds for the flasher heater to cause the metalic plate to close its contacts, depending on the setting of the variable resistance 43.

Because of its orientation the magnet 26 in the last car has no effect on the approach relays. Therefore movement of the last car beyond these relays does not change the status of the gates.

Should the train approach the crossing and stop between the approach relays and the crossing, the gates will be lowered. If the train then backs away from the crossing, the gates will rise again as magnet 22 passes over the outer approach relay, 30A or 32A, while moving away from the crossing. Two switches 46A and 4B are used instead of one switch to insure that the motor is supplied by the power at any time and it will complete the cam cycle; this happens when the train approaches to trigger the closing of the gate and then backs away quickly before the completion and closing of the gate.

Ordinarily the present arrangement will open the gates only when the last car containing magnet 26 passes the grade crossing and this is true regardless of the length of the train, i.e. how many cars are present. However, if the train is assembled without a car containing magnet 26 or if it has no cars at all (i.e. only a single locomotive) the gates will still operate. The only difference will be that the gates will not open until the locomotive has reached the pair of approach relays on the opposite side of the crossing.

Figure 4:
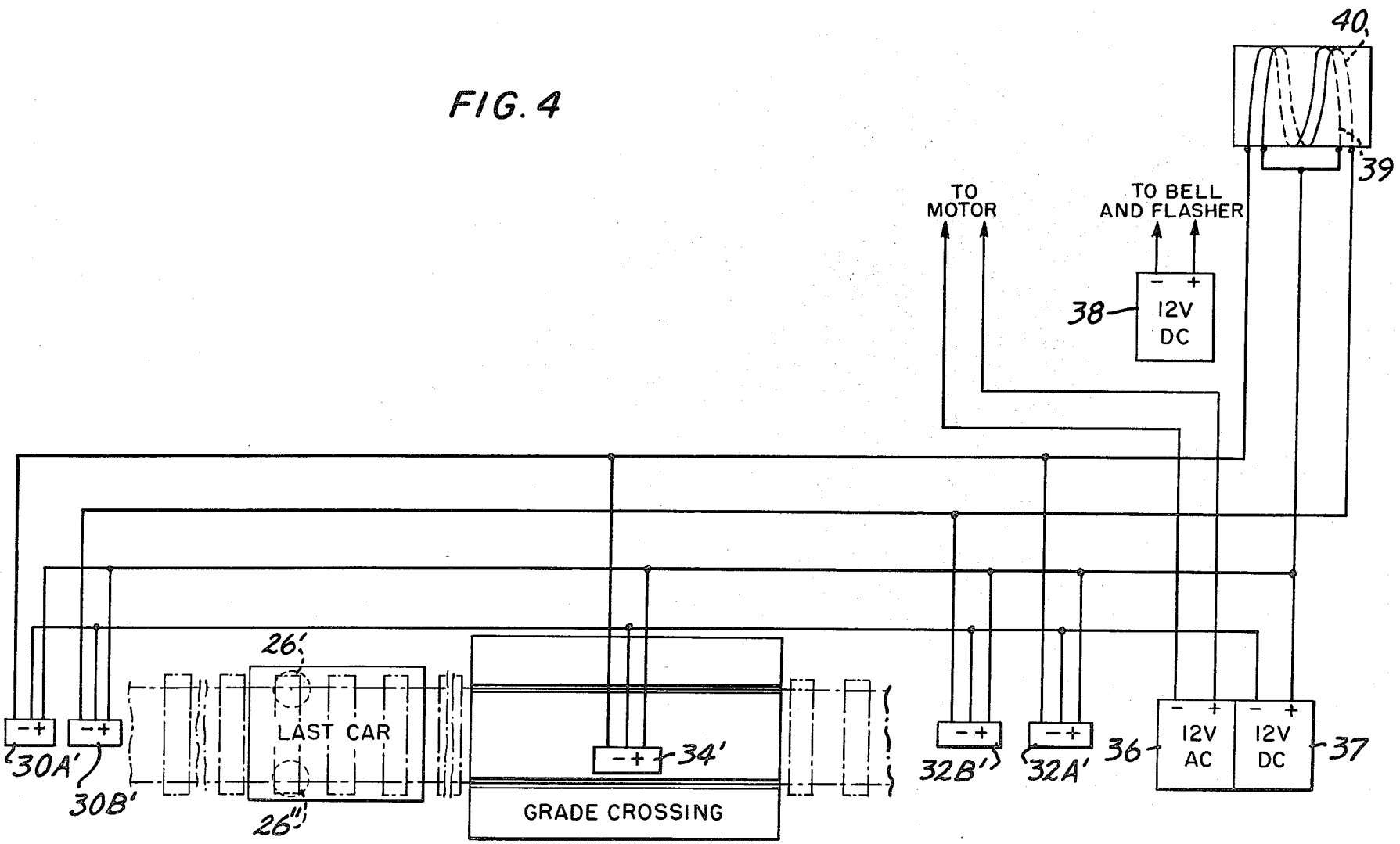
FIG. 4 illustrates a circuit similar to FIG. 1, but using Hall-effect relays.

Instead of magnetic reed relays, the detection circuit can be arranged to use Hall-effect devices as shown in FIG. 4. FIG. 4 is similar to FIG. 1 and similar parts have been marked with the same reference numbers. The Hall-effect devices all require a separate D.C. voltage, e.g. 12 VDC, which is generated by power supply 37. This supply may operate from the same transformer as the AC supply 36. In addition the positive side of D.C. supply 37 is connected to one side of latch coil 40 and a separate release coil 39 of the latching relay. The Hall-effect devices are grouped as two pairs of approach relays 30', 32' on either side of the crossing and a crossing relay 34' at the crossing and located at the side of the track, not in the middle, otherwise it is activated by the magnet carried by the engine, much in the same way as the reed relays of FIG. 1. The outer Hall-effect devices, 30A' and 32A', connect the ground of supply 37 to the other side of release coil 39 of the latching relay when activated by south pole of a small magnet 22' in the locomotive. Device 34' does the same thing when activated by one of two small magnets 26', 26'' each at one side of the last car, this arrangement making it possible for the train to activate Hall-effect device 34 when the train comes from either direction. The effect of magnet 22' on devices 30B' and 32B' is to apply a ground on the other side of latch coil 40 of the latching relay. Thus movement of the train causes the same latching and release of the latching relay in the circuit of FIG. 4 as was achieved with the circuit of FIG. 1. The small size of the Hall-effect devices, however, is an advantage in that they can be located between the ties of the tracks. Thus, extensive modifications to the surface features of existing commercially available track layouts are not necessary. Also, Hall-effect devices are more reliable, durable, and cheaper than the reed relays.

I claim:

1. A model railroad having a train with a locomotive and at least one car traveling along tracks provided with a grade crossing, comprising:

a grade crossing magnetically-operated relay positioned beneath the tracks at the grade crossing and having a particular orientation;

two pairs of adjacent approach magnetically-operated relays positioned beneath the tracks at locations remote from the grade crossing, one pair of approach relays being located on one side of the grade crossing and the other being located on the other side of the grade crossing along the longitudinal extent of the tracks, the orientation of the approach relays being orthogonal to that of the crossing relay;

first and second magnets positioned on the train, the first magnet being located in the locomotive and being oriented to operate the approach relays and the second magnet being located in a last car of the train and being oriented to operate the crossing relay; and a control circuit for operating the crossing gate so as to lower it whenever the first magnet moves over a pair of approach relays while traveling toward the grade crossing, and raises the gate whenever (i) the second magnet moves over the crossing relay or (ii) the first magnet moves over a pair of approach relays while traveling away from the grade crossing.

2. An operating unit as claimed in claim 1 wherein said crossing gate further includes at least one warning light and said control circuit periodically operates said light during lowering of said gate.

3. An operating unit as claimed in claim 1 further including a bell and wherein said control circuit periodically operates said bell during lowering of said gate.

4. An operating unit as claimed in claim 2 further including a bell and wherein said control circuit periodically operates said light and bell synchronously.

5. An operating unit as claimed in claim 4 wherein there are two warning lights for the crossing gate and wherein the lights are alternately operated in synchronism with the operation of the bell.

6. An operating unit as claimed in claim 4 wherein said control circuit comprises:

a latching relay having latched and release states, the crossing relay and the two relays of each pair of approach relays that are farthest from the grade crossing being connected to a power source such that upon operation of these relays the latching relay is put in the release state, the other two approach relays being connected to the power source such that upon operation of these other relays the latching relay is put in the latched state;

a bell coil, a moveable member and an intermittently operating switch connected in series with the power source through contacts of the latching relay when in its latched state, the intermittent switch periodically operating the bell coil to move the movable member against the bell to sound it; and a light switch mechanically connected to the movable member so as to change states in synchronism with the sounding of the bell, said light switch having terminals connected to the warning lights and a common terminal connected to a source of power through the contacts of the latching relay when in its latched state so as to alternately light the warning lights in synchronism with the sounding of the bell.

7. An operating unit as claimed in claim 6 wherein the intermittently operating switch is normally open and requires a certain period in which to close, said period providing a delay in the operation of the bell.

8. An operating unit as claimed in claim 6 wherein said intermittently opening switch is a flasher unit.

9. An operating unit as claimed in claim 8 further including a variable resistance in series with the flasher unit for changing its period of operation.

10. An operating unit as claimed in claim 1 wherein the gate is raised and lowered at approximately the same rate.

11. An operating unit as claimed in claims 1 wherein said control circuit comprises:

a latching relay having latched and release states, the crossing relay and the two relays of each pair of approach relays that are farthest from the grade crossing being connected to a first power source such that upon operation of these relays the latching relay is put in the release state, the other two approach relays being connected to the first power source such that, upon operation of these relays, the latching relay is put in the latched state;

an electrical motor for operating the gate and having a control cam positioned on its output shaft first and second switches alternately operated by said control cam; and a second power source for driving said motor, said second power source being connected to said motor through one or the other of said first or second switches depending on whether the latching relay is in its latched or release state, so as to lower and raise the gate, respectively.

12. An operating unit as claimed in claim 11 further including an operating cam on the output shaft of the motor, and a lever arm moved by said operating cam so as to actuate a control plunger of the crossing gate.

13. An operating unit as claimed in claim 12 wherein there is a delay between the operation of the latching relay and the movement of the control plunger of the crossing gate so as to lower the gate, said delay being caused by a gap between the lever and the control plunger.

14. An operating unit as claimed in claim 1 wherein the approach relays are separated from the grade crossing by a distance greater than the length of the longest train expected.

15. An operating unit as claimed in claim 1 wherein the approach and crossing relays are magnetic reed relays.

16. An operating unit as claimed in claim 1 wherein the approach and crossing relays are Hall-effect devices.

17. A model railroad having a crossing gate, comprising:

a grade crossing magnetically-operated relay positioned at the grade crossing and having a particular orientation;

two pairs of adjacent approach magnetically-operated relays positioned along the tracks at locations remote from the grade crossing, one pair of approach relays being located on one side of the grade crossing and the other being located on the other side of the grade crossing along the longitudinal extent of the tracks, the orientation of the approach relays being orthogonal to that of the crossing relay;

at least a first magnet positioned on a train traversing the tracks and having at least a locomotive, the first magnet being oriented to operate the approach relays; and a control circuit for operating the crossing gate so as to lower it whenever the first magnet moves over a pair of approach relays while traveling toward the grade crossing, and raises the gate whenever the first magnet moves over a pair of approach relays while traveling away from the grade crossing.

18. A detector circuit as claimed in claim 17 wherein the train comprises at least one car in addition to the locomotive, the last car of said train being equipped with a second magnet oriented to operate the crossing relay, and said control circuit acting to raise the gate whenever the second magnet moves over the crossing relay.

* * * * *